US005689761A

United States Patent [19]

Denton et al.

[11] Patent Number: 5,689,761

[45] Date of Patent: Nov. 18, 1997

[54] LIQUID IMMERSION DEVELOPMENT MACHINE HAVING A DEVELOPMENT SYSTEM ADAPTED TO COMPENSATE FOR COPY PAPER ROUGHNESS

[75] Inventors: Gary A. Denton, Lexington, Ky.; Henry R. Till, East Rochester, N.Y.

[73] Assignee: Xerox Corporation, Stamford, Conn.

[21] Appl. No.: 720,285

[22] Filed: Sep. 26, 1996

[51] Int. Cl.[6] ..... G03G 15/00; G03G 15/10

[52] U.S. Cl. ..... 399/45; 399/233; 399/237

[58] Field of Search ..... 399/45, 57, 58, 399/389, 233, 237

[56] References Cited

U.S. PATENT DOCUMENTS

| | | | |
|---|---|---|---|
| 5,162,853 | 11/1992 | Ito et al. | 399/389 X |
| 5,355,201 | 10/1994 | Hwang | 399/241 |
| 5,378,574 | 1/1995 | Winnik et al. | 430/115 |
| 5,459,580 | 10/1995 | Suzuki | 399/45 X |

FOREIGN PATENT DOCUMENTS 2-293761 12/1990 Japan .

*Primary Examiner*—S. Lee
*Attorney, Agent, or Firm*—Tallam I. Nguti

[57] ABSTRACT

A development system for developing a latent image so as to compensate for differences in the surface roughness of different types of copy papers receiving the developed image. The development system includes a development unit for each color of toner particles being used within the machine for latent image development. Each development unit has a first developer material supply source, and a second developer material supply source, containing respectively a first developer material and a second developer material of a same color. In order to more fully correct for hue and density differences in images of the same color developed and transferred onto rough versus smooth surface type copy papers, the first developer material importantly contains a higher level of pigmentation than the second developer material.

7 Claims, 2 Drawing Sheets

LIQUID IMMERSION DEVELOPMENT MACHINE HAVING A DEVELOPMENT SYSTEM ADAPTED TO COMPENSATE FOR COPY PAPER ROUGHNESS

BACKGROUND

This invention relates generally to electrostatographic reproduction machines, and more particularly to a liquid immersion reproduction machine having a development system adapted to compensate for differences in surface roughness of different types of copy paper.

In electrophotographic printing, a charged photoconductive member is exposed to a light image of an original document. The irradiated areas of the photoconductive surface are charged to record an electrostatic latent image thereon corresponding to the informational area contained within the original document. Generally, the electrostatic latent image is developed by bringing a developer mixture into contact therewith. A dry developer mixture usually comprises carrier granules having toner particles adhering triboelectrically thereto. Toner particles are attracted from the carder granules to the latent image forming a toner powder image thereon.

Alternatively, a liquid developer material or materials of different colors may be employed in what is referred to as a Liquid Immersion Development (LID) electrophotographic reproduction machine for developing the latent image. Liquid development is frequently carded out with a rotating developer roller immersed or partially immersed in a liquid developer material or developer bath with a stationary electrode being employed to create the necessary electrostatic field between the developer roller and the photoconductive surface. However, liquid development as disclosed, for example, in U.S. Pat. No. 5,355,201 can also be carried out with an applicator head or lip supplying liquid developer material from a supply source directly to a latent image on the photoconductive surface to develop the latent image.

As disclosed for example in U.S. Pat. No. 5,378,574 liquid developer materials typically each include a colorless liquid carrier having dispersed therein, charged solid toner particles at a desired concentration level, and dye or pigment particles loaded at a desired level by bonding them to the toner particles forming charged pigmented toner particles. Typically to develop with such liquid developer material, it is brought into contact with an electrostatic latent image so that the charged pigmented toner particles, along with some of the liquid carrier, are attracted by the latent image, thus developing the image. After such image development on the photoconductive surface, the image is conditioned to remove excess liquid carrier therefrom, and is subsequently transferred to a copy sheet for fusing to form a finished hard copy.

The quality of the finished hard copy depends in great part on the selections and effectiveness of development parameters, such as a toner concentration level, a toner pigmentation level, and a charge level In a LID reproduction machine, the practice for example is to set and control at a single desired point or level, the toner concentration in each developer material, for each color of toner particles being used for image development. In order to have uniform looking quality toner images, the toner particles at such a desired concentration level usually a/so have only one desired level of pigmentation.

Unfortunately, it has been found, particularly in multicolor LID reproduction machines, that the use of the same developer materials each having one toner concentration level, and one pigmentation level for developing images to be transferred onto copy papers having different surface roughnesses, ordinarily results in undesirable color shifts in some transferred images. In other words, it has been found that when transferring images developed with developer materials of the same color onto both smooth surface and rough surface papers, the apparent hue and density of the image will change on relatively rough surface papers due to loss of gloss on such papers.

While this effect can be compensated for to some extent by doubling or tripling the developed mass on the rough paper, simply increasing the mass will instead tend to cause a loss of latitude in the development, in image conditioning, and in transfer and transfuse subsystems. It was additionally found that merely increasing the toner concentration, and thus merely increasing the developed mass per unit image area, does not sufficiently prevent detectable hue and density differences between conventionally developed images transferred to rough surface type copy papers.

There is therefore a need for a LID reproduction machine having a development system adapted to develop images so as to compensate for differences in the surface roughness of different types of copy paper.

SUMMARY OF THE INVENTION

Pursuant to an aspect of the present invention, there is provided a liquid immersion development reproduction machine including an image bearing member having a photoconductive imaging surface; latent imaging devices for recording an electrostatic latent image on the imaging surface; an electronic control subsystem for controlling elements and process of the machine; copy sheet supply units for holding and selectively supplying different types of copy sheets each type having a different surface roughness; and a development system for developing the latent image so as to compensate in such development for differences in the surface roughness of the different types of copy papers receiving the developed image. The development system includes a development unit for each color of toner particles being used within the machine for latent image development. Each development unit has a first, and at least a second, developer material supply source containing respectively a first developer material and a second developer material of a same color. In order to more fully correct for hue and density differences in images of the same color developed and transferred onto rough versus smooth surface type copy papers, the first developer material importantly contains a higher level of pigmentation than the second developer material.

BRIEF DESCRIPTION OF THE DRAWINGS

Other aspects of the present invention will become apparent as the following description proceeds and upon reference to the drawings, in which.

DESCRIPTION OF THE INVENTION

Figure 1:
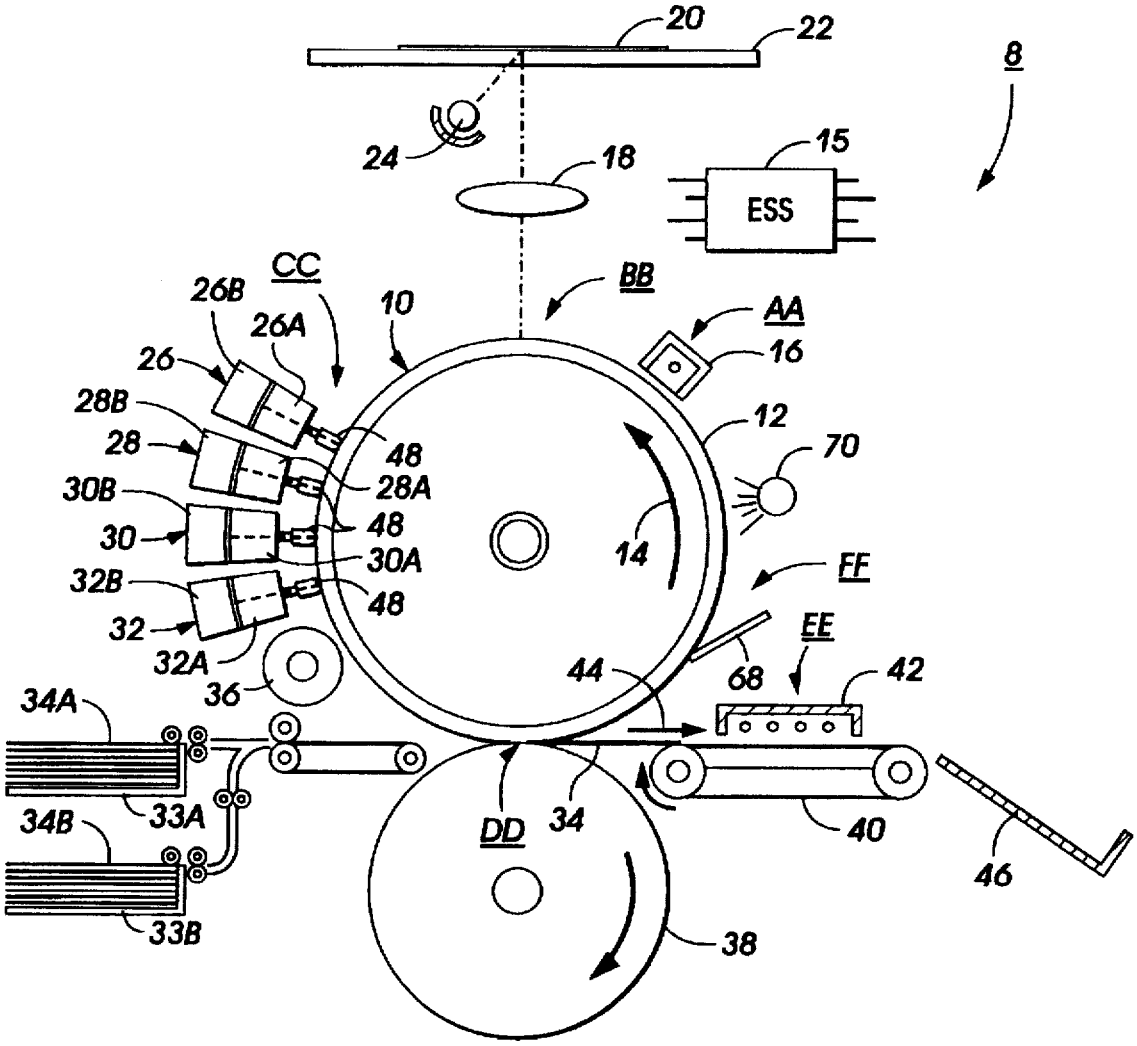
FIG. 1 illustrates a multicolor LID reproduction machine including a development system having multiple varying pigmentation developer material supplies of the same color to compensate for differences in copy paper surface roughness.

For a general understanding of the features of the present invention, reference is made to the drawings. In the drawings, like reference numerals have been used throughout to designate identical elements. FIG. 1 is a schematic elevational view illustrating an electrophotographic LID reproduction machine 8 incorporating the features of the present invention therein. It will become apparent from the following discussion that the apparatus of the present invention may be equally well suited for use in a wide variety of LID reproduction machines and is not necessarily limited in its application to the particular embodiment.

Referring now to FIG. 1, the electrophotographic LID reproduction machine 8 employs a photoconductive member 10 shown as a drum mounted rotatably within the machine. A photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with an electronic control subsystem (ESS) 15 of the machine, so as to synchronize and control the various aspects and operations of the machine with the rotation of drum 10. In this manner, the proper sequence of events is produced at the respective processing stations.

As illustrated, drum 10 initially rotates with its photoconductive surface 12 through charging station AA. At charging station AA, a corona generating device, indicated generally by the reference numeral 16, sprays ions onto photoconductive surface 12 producing a relatively high, substantially uniform charge thereon. Next, the charged photoconductive surface is rotated on drum 10 to exposure station BB. At exposure station BB, a light image of an original document is projected onto the charged portion of the photoconductive surface 12.

Exposure station BB, for example, includes a moving lens system, generally designated by the reference numeral 18. An original document 20 is positioned face down on a generally planar, substantially transparent patent 22.

In operation, a filter is employed in association with lens 18 so that a selected color is transmitted onto photoconductive surface 12 to selectively discharge portions thereof. For example, a red filter is employed to discharge selected areas with the charged areas being developed with the subtractive primary of red, i.e. cyan colored liquid developer material.

Lamps 24 are adapted to move in a timed relationship with lenses 18 to scan successive incremental areas of original document 20. In this manner, a flowing light image of original document 20 is projected onto the charged portion of photoconductive surface 12. This selectively dissipates the charge on photoconductive surface 12 to record an electrostatic latent image thereon corresponding to the informational areas in original document 20. Selected optical filters (not shown) having colors complimentary to the color of the respective liquid developer materials are interposed into the light path to optically filter the light image.

While a light lens system has heretofore been described, one skilled in the art will appreciate that other techniques may be used, such as a raster output scanner employing a modulated laser beam to discharge selected areas of the photoconductive surface to record the electrostatic latent image thereon.

After exposure, drum 10 rotates the electrostatic latent image recorded on photoconductive surface 12 to a development system station CC including developer units in accordance with the present invention. As shown, development system station CC includes a plurality of development or developer units in accordance with the present invention, generally indicated by the reference numerals 26, 28, 30 and 32. Each of the developer units 26, 28, 30 and 32 is suitable for developing a latent image on the imaging surface so as to compensate for differences in the surface roughness of the different types of copy papers receiving the developed image. Except for the fact that each contains a different color of developer materials, the developer units 26, 28, 30 and 32 are substantially identical to one another. Accordingly, a detailed description of one, e.g. unit 26, will suffice for a similar description of each of the others.

Liquid developer materials suitable for the color machine 8 generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures.

Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles should have an average particle diameter from about 0.2 to about 10 microns, and preferably from about 0.5 to about 2 microns, may be present in amounts of from about 1 to about 10, and preferably from about 2 to about 4 percent by weight of the developer composition. Such toner particles can be any colored particle compatible with the liquid medium or carrier. For example, the toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like.

Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present.

Suitable pigmentation or pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight.

In accordance with the present invention, (to be described below) a first developer material "Da" of any one color will advantageously be made to have a pigmentation level of about 18% by weight of the toner particles for developing images to be transferred onto relatively rough surface type copy paper. A second developer material "Db" of the same color is made to have a significantly lower level of pigmentation, e.g. 10% by weight of the toner particles, and is provided at the same developer unit for developing images to be transferred onto relatively smooth surface type copy papers.

Examples of suitable charge control agents include lecithin (Fisher Inc.); OLOA 1200, a polyisobutylene succinimide available from Chevron Chemical Company; basic barium petronate (Witco Inc.); zirconlure octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

Figure 2:
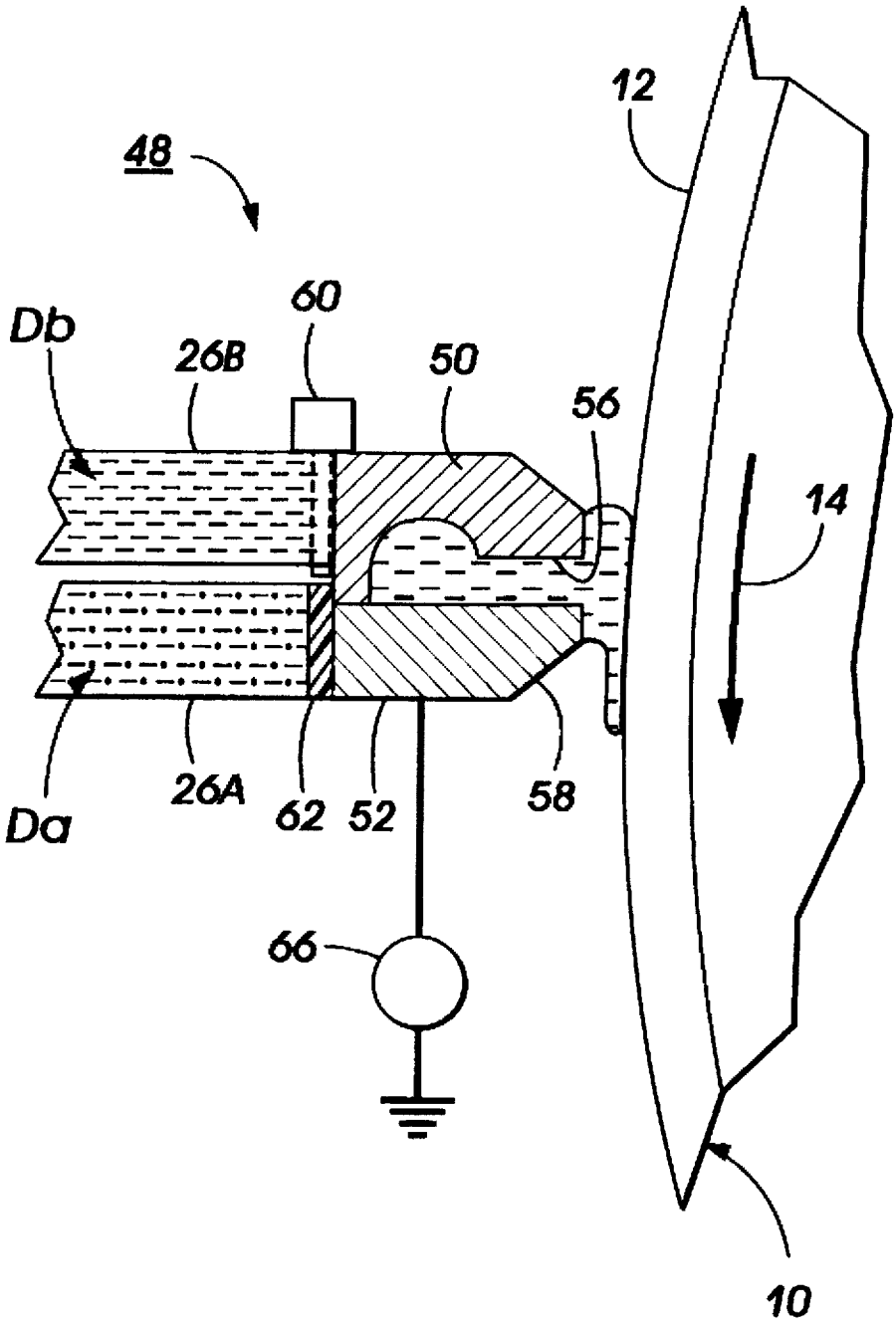
FIG. 2 is an enlarged elevational view, partially in section, showing a common developer material applicator for each development unit of the development system of FIG. 1.

Referring now to FIGS. 1 and 2, each development unit, e.g. 26, has a first developer material supply source 26A, and at least a second developer material supply source 26B, containing respectively a first developer material Da, and a second developer material Db, of a same color. As such, the first and second sources 26A, 26B each supply one color, e.g. cyan developer materials, and 28A, 28B a second color, 30A, 30B a third color, and 32A, 32B a fourth color.

Importantly in accordance with the present invention, in each developer unit 26, 28, 30, 32, the first developer material Da of each color importantly is made to contain a higher level of pigmentation than the second developer material Db of that color. This is in order to more fully correct for hue and density differences in toner images of the same color that are transferred onto a sheet 34 comprising relatively rough versus relatively smooth surface type copy papers 34A, 34B. For example, the pigmentation level of each first developer material Da at each developer unit is preferably 18% (by weight of the toner particles), while that of the second developer material Db at that developer unit is significantly less at about 10% (by weight of the toner particles).

As further illustrated in FIGS. 1 and 2, each developer unit, e.g. 26 includes a common developer material applicator assembly 48 that is connected to the first and to the second supply sources, e.g. 26A, 26B, of each developer unit 26, 28, 30, 32. The developer material applicator assembly 48 of each developer unit, includes an applicator tip 58. Each applicator assembly 48 includes a first member 50 and a second member 52 that define a channel 56 for extruding developer material to the application tip 58 thereof. It also includes a control means 60 and a gating device 62 that are connected to the ESS control subsystem 15, for selectively extruding a layer of either the first developer material Da, or the second developer material Db of the particular color of the developer unit onto the electrostatic latent image being developed.

Accordingly, the electronic control subsystem 15 is programmed to select for any given color, the first higher pigmentation developer material Da from the first supply source 26A, 28A, 30A, 32A when the copy paper supplied is a relatively rough surface type copy paper. It is also programmed to select for any given color, the second relatively lower pigmentation developer material Db from the second supply source 26B, 28B, 30B, 32B when the copy paper supplied is a relatively smooth surface type copy.

Referring now to FIG. 2, a voltage source 66 is provided for electrically biasing liquid applicator 48 of each developer unit to a suitable magnitude and polarity so as to ensure that the electrostatic latent image recorded on the surface 12 attracts the liquid developer material Da, Db thereto.

By way of example, when the sheet supply source selected is 33A (containing the first type of copy sheets 34A each having a relatively rough image receiving surface), developer unit 26 will be controlled to extrude cyan colored first developer material Da from the first source 26A, and developer unit 28 similarly will extrude magenta colored developer material of the first type thereof Da, from its first source 28A. Similarly, developer unit 30 will extrude yellow colored developer material from its first source 30A, and developer unit 32 will extrude black colored developer material from its first source 32A.

When the sheet supply source selected is 33B containing the second type of copy sheets 34B each having a relatively smooth image receiving surface, developer units 26, 28, 30 and 32 (under the control of the ESS 15) will each extrude the second developer material Db of their respective colors from their respective second supply sources 26B, 28B, 30B, and 32B in accordance with present invention.

Referring again to FIG. 1, each liquid toner image formed on the imaging surface 12 in accordance with the present invention, may be transferred after its respective cycle, to a suitable selected copy sheet 34A, or 34B selectively fed from copy sheet supplies 33A or 33B as shown. Alternatively, successive liquid images may be developed in superimposed registration with one another on the surface 12, thus forming a composite multicolor liquid image, then followed by such transfer. For example, copy sheet type 34A has a relatively rough image receiving surface, and copy sheet type 34B has a relatively smooth image receiving surface. In either case, the toner image is transferred as such at a transfer station DD.

In accordance with the present invention, the composite multicolor liquid toner image will be transferred to a copy sheet 34A, or 34B depending on whether the type of developer material used was a high pigmentation material Da, or a low pigmentation material Db. As also shown, prior to such transferring of the multicolor liquid toner image to a copy sheet 34A, or 34B, the image is contacted and conditioned by a conditioning roller 36.

At the transfer station DD, a transfer roller 38 is provided and maintained at a suitable voltage and temperature, for assisting in an electrostatic transfer of the image from photoconductive surface 12 to copy sheet 34A, or 34B. Preferably, transfer roller 38 applies pressure and is electrically biased to ensure the transfer of the composite multicolor liquid image to sheet 34A, 34B.

After the composite multicolor liquid toner image has been transferred to a selected copy sheet 34A, or 34B, the copy sheet advances on conveyor 40 through fusing station EE. Fusing station EE includes a radiant heater 42 which radiates sufficient heat energy to permanently fuse the toner to copy sheet 34A, 34B in image configuration. Conveyor belt 40 advances the copy sheet in the direction of arrow 44, through radiant fuser 42 to catch tray 46. When copy sheet 34A, 34B is located in catch tray 46, it may be readily removed therefrom by the machine operator.

With continued reference to FIG. 1, invariably, some residual liquid developer material remains adhering to photoconductive surface 12 of drum 10 after the transfer thereof to copy sheet 34A, 34B. This material is removed from photoconductive surface 12 at cleaning station FF. Cleaning station FF, for example, includes a flexible resilient blade 68. This blade has the free end portion thereof in contact with photoconductive surface 12 to remove any material adhering thereto. Thereafter, lamp 70 is energized to discharge any residual charge on photoconductive surface 12 preparatory for the next successive imaging cycle. In this way, successive electrostatic latent images may be developed.

The development system of the present invention may be utilized in a multicolor electrophotographic LID reproduction machine or, in a monocolor printing machine. The developed image may be transferred directly to a copy sheet or to an intermediate member prior to transfer to the copy sheet. Multicolor LID reproduction machines may use this type of development unit where successive latent images are developed to form a composite multicolor toner image which is subsequently transferred to a copy sheet or, in lieu thereof, single color liquid images may be transferred in superimposed registration with one another directly to the copy sheet In recapitulation, each developer unit 26, 28, 30, 32 of the development system of the present invention has a first developer material supply source 26A, 28A, 30A, 32A, and a second developer material supply source 26B, 28B, 30B, 32B containing respectively a first developer material Da, and a second developer material Db of a same color. In order to more fully correct for hue and density differences in images of the same color developed and transferred onto rough versus smooth surface type copy papers, the first developer material Da importantly contains a higher level of pigmentation than does the second developer material Db.

The problem of color shifts when developing and transferring liquid toner images onto both smooth surface and rough surface copy papers is addressed by connecting a liquid developer materials applicator assembly 48 for a given color of developer material to two or more sumps, where each sump contains the same color of developer material but at different pigment loadings in the toner. When developing and transferring liquid toner images onto smooth surface papers, each applicator is advantageously switched to a sump containing developer material of the color having a relatively lower pigment loading. On the other hand, for images to be transferred to relatively rough surface papers, sumps containing developer materials having relatively higher pigment loadings will be selected so as to compensate for the effects of otherwise apparent lower gloss on such rough surface papers. The pigment or hue used in each sump can also be varied slightly from one pigment loading to the next so as to provide additional compensation for such effects of paper roughness.

It has been found that the major part of the hue and density correction in toner developed images transferred onto copy sheets can be accomplished by adjusting the pigmentation (both loading and pigments) of the toners used for images to be transferred to each paper type. To do so, each color developer material is provided in two or more pigmentation levels in separate sumps which are selectable for connection to an applicator, depending on the paper type selected. The need for flushing each applicator between developer material sump changes will be minimal because the developer materials being supplied through each applicator are the same color or are very close in color.

It is, therefore, apparent that there has been provided, in accordance with the present invention, an apparatus for developing an electrostatic latent image with a first liquid developer material of a first color having a first level of pigmentation, or with a second developer material of the same first color having a second and significantly lower level of pigmentation, depending on whether the copy sheet to receive the developed image is a rough surface type or a smooth surface type paper. This apparatus thus fully satisfies the aims and advantages hereinbefore set forth.

While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A liquid immersion development (LID) reproduction machine for producing quality toner image hard copies on different types of copy sheets where each type of sheet has a different surface roughness, the reproduction machine comprising:

(a) a moveable image bearing member having an imaging surface defining a path of movement therefor;

(b) latent image forming means mounted along said path of movement for forming a latent image on said imaging surface;

(c) a plurality of copy sheet supply units including a first unit supplying a first type of copy sheet having a relatively rough image receiving surface, and a second unit supplying a second type of copy sheet having a relatively smooth image receiving surface, for receiving a toner image from said imaging surface;

(d) an electronic control subsystem connected to each operating unit of the machine including the copy sheet supply units for selectively controlling operation of each such operating unit; and (e) a development system including a development unit mounted along said path of movement and connected to said control subsystem for developing the latent image so as to produce a toner image compensating for differences in the surface roughness of the different types of copy sheets receiving the toner image; said development unit including:

(i) a first developer material supply source containing a selectable first developer material having a first color and a first level of pigmentation for developing a latent image to be transferred onto the first type of copy sheet supplied from said first copy sheet supply unit; and (ii) a second developer material supply source containing a selectable second developer material having said first color and a second level of pigmentation, different from said first level of pigmentation, for developing a latent image to be transferred onto the second type of copy sheet supplied from said second copy sheet supply unit, thereby varying the levels of pigmentation of developer material of said first color so as to produce high quality toner images for compensating for differences in the surface roughness of the different types of copy sheets.

2. The LID reproduction machine of claim 1, wherein said first developer material supply source supplying said first developer material, and said second developer material supply source supplying said second developer material, are connected to a common developer material applicator for applying a layer of either said first developer material or said second developer material to a latent image being developed.

3. The LID reproduction machine of claim 1, wherein said first level of pigmentation is significantly higher than said second level of pigmentation.

4. The LID reproduction machine of claim 1, wherein said development system includes a plurality of development units for producing a multicolor toner image, each development unit of said plurality of development units containing a first developer material and a second developer material having a same color, and supplying said first developer material or said second developer material for developing said same color of a latent image.

5. The LID reproduction machine of claim 2, wherein said first level of pigmentation is about 18% by weight of toner particles, and said second level of pigmentation is about 10% by weight of toner particles.

6. In a liquid immersion development (LID) reproduction machine developing and transferring toner images onto copy sheets of paper, a development unit for developing latent images so as to produce toner images compensating for differences in a surface roughness of different types of copy sheets receiving the toner images, the development unit comprising:

(a) a first developer material supply source containing a selectable first developer material, having a first color and a first level of pigmentation, for developing a latent image to be transferred onto a first type of copy sheet having a first type of image receiving surface;

(b) a second developer material supply source containing a selectable second developer material, having said first color and a second level of pigmentation different from said first level of pigmentation, for developing a latent image to be transferred onto a second type of copy sheet having a second and different type image receiving surface, thereby varying the level of pigmentation of developer material of said first color to produce high quality toner images compensating for differences between types of image receiving surfaces of copy sheets; and (c) control means connected to said development system for selecting either said first developer material supply source or said second developer material supply source, for supplying said first developer material or said second developer material responsively to a type of copy sheet selected to receive the latent image being developed.

7. The development unit of claim 6, wherein said first level of pigmentation is significantly higher than said second level of pigmentation.

* * * * *